US005147093A

United States Patent [19]

Tisdale

[11] Patent Number: 5,147,093

[45] Date of Patent: Sep. 15, 1992

[54] PUZZLE BOLT

[76] Inventor: Roger B. Tisdale, R.R. 5, Box 215, Fayetteville, Ark. 72701

[21] Appl. No.: 765,324

[22] Filed: Sep. 25, 1991

[51] Int. Cl.[5] ..... A63F 9/08; F16B 23/00

[52] U.S. Cl. ..... 273/156; 273/153 R; 411/5; 411/383; 411/397

[58] Field of Search ..... 273/153 R, 156; 411/396, 397, 383, 366, 368, 3, 5

[56] References Cited

U.S. PATENT DOCUMENTS

| | | | |
|---|---|---|---|
| 514,570 | 2/1984 | Stancliff | 273/153 R |
| 865,207 | 9/1907 | Reed | 273/156 |
| 956,441 | 4/1910 | Smith | 273/156 |
| 1,111,337 | 9/1914 | Watkins | 273/156 |
| 3,813,099 | 5/1974 | Scott | 273/156 |
| 4,840,529 | 6/1989 | Phillips | 411/397 |

FOREIGN PATENT DOCUMENTS

| | | | |
|---|---|---|---|
| 0085817 | 6/1958 | Denmark | 273/156 |
| 2066401 | 7/1981 | United Kingdom | 411/383 |

OTHER PUBLICATIONS

Slocum, Jerry, "Puzzles", 1986, p. 58.

Playthings, "Lakeside Puzzle Challenge", Mar. 1971, p. 241.

*Primary Examiner*—V. Millin

*Assistant Examiner*—Steven B. Wong

*Attorney, Agent, or Firm*—H. Jay Spiegel

[57] ABSTRACT

A puzzle is disclosed which includes an elongated left-hand threaded bolt carrying a split lock washer and having a nut at one end. The other end of the bolt is partially threaded into a second nut which has a short length of another bolt threaded at its end. The object of the puzzle is to figure out how to remove the lock washer from the bolt.

2 Claims, 1 Drawing Sheet

PUZZLE BOLT

BACKGROUND OF THE INVENTION

The present invention relates to a puzzle bolt. In the prior art, puzzle devices wherein some structure must be taken apart are known. U.S. Pat. Nos. D246,922 to Heign and 4,512,582 to Dallaire et al. are known to Applicant and disclose puzzles wherein the object is to take some component apart. However, the present invention differs from the teachings of these patents in structure as well as function.

SUMMARY OF THE INVENTION

The present invention relates to a puzzle bolt. The present invention includes the following interrelated objects, aspects and features:

(a) In a first aspect, the inventive puzzle includes an elongated bolt which is left-hand threaded as compared to the majority of bolts which are sold and which are right-hand threaded.

(b) At one end of the left-hand threaded bolt, a nut having angular peripheral grooves is threaded and then welded such that it is fixed in position on that end of the elongated bolt.

(c) At the other end of the bolt, a further nut having angular peripheral grooves is threaded over the elongated bolt but only partially. The rest of the interior threaded opening of this second-mentioned nut contains a short length of threaded bolt which is welded within the opening of the nut. In this way, unbeknownst to individuals trying to solve the puzzle, this second-mentioned nut may easily be removed from the elongated left-hand threaded bolt by rotating this second-mentioned nut in the clockwise direction. However, individuals trying to solve the puzzle will not realize that the elongated bolt is left-hand threaded and will attempt to unscrew the nut in a counterclockwise direction. This direction of rotation of the second-mentioned nut will tend to tighten it rather than loosen it.

(d) On the elongated bolt, between the nuts, a lock washer is contained. The object of the puzzle is to find a way to remove the split lock washer without bending it or otherwise deforming the entire device. The split in the lock washer causes two ends of the lock washer to be spaced from one another. The angular peripheral grooves in the nuts will lead an individual attempting to solve this puzzle to believe that the washer may be removed by engaging the ends thereof with these grooves. However, the grooves and washer ends are sized and configured to preclude such removal.

As such, it is a first object of the present invention to provide a puzzle bolt.

It is a further object of the present invention to provide such a device including features tending to fool an individual attempting to solve the puzzle.

It is a still further object of the present invention to provide such a device which may easily be solved should one know its secret.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
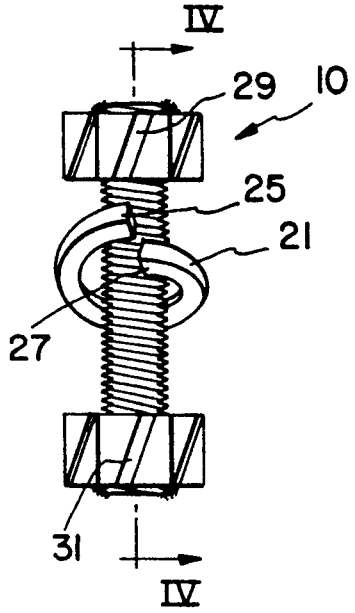
FIG. 1 shows a side view of the present invention.
Figure 4:
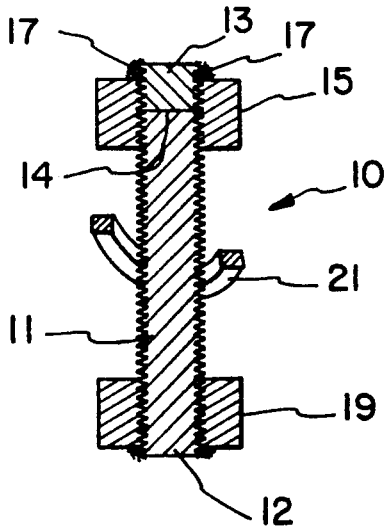
FIG. 4 shows a cross-sectional view along the line IV-IV of FIG. 1.
Figure 3:
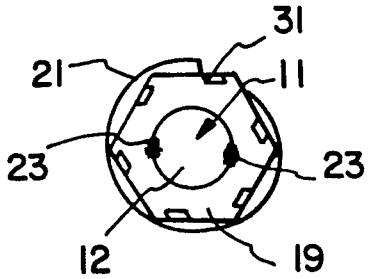
FIG. 3 shows a bottom view of the present invention.

With reference, in particular, to FIGS. 1 and 4, the inventive device is generally designated by the reference numeral 10 and includes an elongated left-hand threaded bolt 11. In the orientation shown in FIGS. 1 and 4, at the bottom of the elongated bolt, a left-hand threaded nut 19 is screwed over the end 12 of the bolt 11 and is welded at 23 as shown in FIG. 3.

Figure 2:
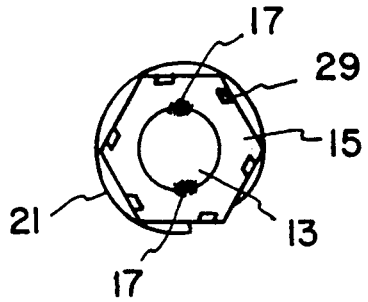
FIG. 2 shows a top view of the present invention.

The other end 14 of the elongated bolt 11 is partially threaded into an additional left-hand threaded nut 15 as best seen in FIG. 4. The rest of the bore through the nut 15 is occupied by a short left-hand threaded piece 13 which is welded to the nut 15 with the welds 17 as seen in FIGS. 2 and 4. Thus, with the parts assembled as shown in FIGS. 1 and 4, it appears that the nuts 15 and 19 are threaded over the ends of a single integral elongated rod and are welded in position to preclude their removal. In reality, the nut 15 may easily be removed from the elongated rod 11 by rotating the nut 15 in the clockwise direction. Since most threaded members are "right-hand" threaded, a person trying to disassemble the device 10 will naturally attempt to rotate the nut 15 in the counterclockwise direction, a direction which tends to tighten the nut 15 on the elongated rod 11.

As shown in the figures, a split lock washer 21 having end faces 25, 27 is captured between the nuts 15, 19. The object of the puzzle is to remove the washer 21 without damaging or deforming the rest of the device 10. Of course, one who knows the secret of the left-hand threaded nature of the components may easily remove the nut 15. However, one who is not aware of this secret will find it difficult to figure out how to liberate the washer 21.

In a further aspect, the nut 15 has angularly cut grooves 29 which are best seen in FIG. 1 and the nut 19 has angularly cut grooves 31, also best seen in FIG. 1. These grooves are provided to make the user think that these grooves 29, 31 may be used in some way to remove the washer 21 by, for example, allowing one of the ends 25, 27 of the washer 21 to enter a respective groove 29 or 31 to attempt to allow removal of the washer 21 from between the nuts 15, 19. In this regard, the grooves 29, 31 and the structure and configuration of the washer 21 are specifically designed to preclude such removal.

In the use of the present invention, the nut 15 is removed from the end 14 of the elongated bolt 11 by rotating the nut 15 in the clockwise direction in the view of FIG. 2. With the nut 15 with its attached threaded piece 13 removed from the elongated bolt 11, the washer 21 may easily be dropped over the elongated bolt 11 whereupon the nut 15 may be threaded counterclockwise in the view of FIG. 2 until it is tightened against the threaded piece 13 as particularly shown in FIG. 4.

In this orientation of parts, the device 10 may be given to someone so that they may attempt to remove the washer 21 from the rest of the device without damage or deformation.

As such, an invention has been disclosed in terms of a preferred embodiment which fulfills each and every one of the objects of the invention as set forth hereinabove and provides a new and useful puzzle bolt of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved puzzle, comprising:

a) an elongated left-hand threaded bolt having a first end and second end;

b) a first nut fixedly mounted on said first end;

c) a second left-hand threaded nut having a left-hand threaded passageway therethrough, said passageway having a first region and a second region;

d) said first region being filled with a short left-hand threaded rod fixedly mounted therein and extending slightly outwardly from said first region whereby left-hand threaded side walls thereof are visible;

e) said second region being threaded over said second end of said bolt with said second end tightened against said short rod;

f) a split ring captured between said first nut and said second left-hand threaded nut, said split ring having a split defined by two opposed faces which are misaligned with respect to one another; and g) said first nut and said second left-hand threaded nut each having outer peripheral surfaces with grooves therein to give a mistaken impression that said split ring may be removed from said bolt by allowing at least one of said faces of said split ring to enter one of said grooves.

2. The invention of claim 1, wherein said first nut and second left-hand threaded nut are fixedly mounted on said bolt and short rod, respectively, with welds.

* * * * *